United States Patent [19]

Hartley

[11] 3,984,056

[45] Oct. 5, 1976

[54] WORM WITH DEFLECTOR

[75] Inventor: Richard S. Hartley, Troy, Ohio

[73] Assignee: Hobart Corporation, Troy, Ohio

[22] Filed: Sept. 4, 1974

[21] Appl. No.: 503,175

[52] U.S. Cl. ..... 241/82.1

[51] Int. Cl.[2] ..... B02C 18/30

[58] Field of Search ..... 241/82.1, 82.2, 101.6, 241/82.4

[56] References Cited

UNITED STATES PATENTS

| | | | |
|---|---|---|---|
| 3,461,934 | 8/1969 | Waters | 241/82.1 |
| 3,653,420 | 4/1972 | Viene | 241/82.1 |
| 3,768,741 | 10/1973 | Mills | 241/82.1 |

*Primary Examiner*—Roy Lake
*Assistant Examiner*—E. F. Desmond
*Attorney, Agent, or Firm*—Biebel, French & Nauman

[57] ABSTRACT

A mixer-grinder for food products, particularly meat products, which includes a hopper for receiving the products, mixing arms rotatable in the hopper, a barrel extending from the hopper and a worm rotatably mounted within the hopper and extending into the barrel. The worm is provided with a deflector at the entrance to the barrel which deflects or kicks out frozen particles of food and prevents accumulation of frozen chips within the barrel, and consequent stalling of the machine.

12 Claims, 7 Drawing Figures

WORM WITH DEFLECTOR

BACKGROUND OF THE INVENTION

U.S. Pat. No. 3,570,569 discloses a food mixing machine provided with a grinder which is designed so that the mixer can be operated either independently of or in conjunction with the grinder. Machines of this type are used extensively for preparing food products, particularly meat. The products deposited in the hopper of the mixer-grinder machine may include, in addition to seasonings and other additives, both frozen and unfrozen meat.

The frozen meat may be in stick form, which results from sawing blocks of frozen meat into elongated sticks, but a more popular form is in the form of chips or flakes which result from dividing the meat with a rotating blade device similar to a wood planer. Although chips tend to feed faster and therefore jam in a grinder they are more popular since their preparation requires less labor. While all of the meat products deposited in the hopper may be in frozen chip or flake form, more common practice is to have only a portion of the hopper contents frozen with the remainder unfrozen.

In either case, if the frozen particles are fed into the grinder barrel too rapidly by the feeder worm an excessively large worm driving torque is required since frozen particles are not readily extruded from the barrel through the grinder plate in the same manner as unfrozen meat, but must in reality be heated to at least a semi-plastic state (near 26 ° Fahrenheit, for example) before passing through the grinder plate. It is therefore found that the pressure of a large quantity of chips in the barrel may cause the machine to stall.

One possible solution to this problem would be to control carefully the amount of frozen particles deposited in a grinder hopper. In practice, however, this is impractical since it requires constant monitoring of the feed operation and since the feeder worm is found to have an affinity for chips, particularly chips of a certain size. Another approach is to increase the capacity of the motor and gear train of the machine. Obviously, this solution appreciably increases the cost and energy supply requirements of the machine.

Many prior art patents are directed to the feeding of products into mixers and/or grinders, such as U.S. Pat. No. 3,213,911. In this patent, a separate shaft is provided having radially projecting arms or blades with sharp cutting edges mounted thereon adapted to rotate between the turns of the conveyor screw. It will be apparent, however, that this provision requires additional bearings and drive for the shaft carrying the cutting blades, and would both increase the cost of the machine and require additional cleaning time.

Other patents of interest in this area are U.S. Pat. Nos. 309,381; 443,590; 474,595; 1,056,153; 1,736,333; and 2,210,006. In each of these patents, as in U.S. Pat. No. 3,213,911, an attempt is made to comminute pieces of material and a common approach, as shown in some of these patents, is to utilize cooperating moving and stationary blades for this purpose.

Also of interest with regard to improvements in material feeder worms is U.S. Pat. No. 2,072,406 wherein a material dispersing projection is added near one end of the coal feeding worm of a steam locomotive. In this patent the worm projection is added for the purpose of dispersing coal which would otherwise accumulate and cause a jam when the worm is reverse driven during the dislodging of an obstructing object.

SUMMARY OF THE INVENTION

The present invention provides food handling equipment in which the amount of frozen particles fed into the barrel of the machine is controlled by means of a deflector positioned at the entrance to the barrel of the machine. This deflector serves to kick a portion of the frozen particles out of engagement with the worm as these particles approach the barrel.

In a preferred embodiment of the machine the deflector is formed as a vane projecting radially outwardly from the surface of the worm and extending longitudinally of the worm from the hopper into the barrel.

In this form of the invention, the vane extends up a face of the convolution of the worm disposed oppositely to the entrance to the barrel. This has been found to provide improved chip deflection over a construction in which the vane merely terminates at the face of the convolution.

In another form of the invention, the deflector may take the form of a chord-like member positioned at the entrance to the barrel. In either case, the deflector, while allowing unfrozen material to be fed freely into the barrel, kicks out or deflects frozen chips or particles to insure that an extensive amount of frozen particles is not fed into the barrel.

Although the material deposited in the hopper will usually consist of frozen and unfrozen products, if the material consists essentially of frozen chips, it has been found that the deflector will allow some chips to pass into the barrel, but not at a sufficient rate to cause jamming and stalling of the machine.

It has also been found that the effectiveness of the vane deflector varies desirably according to the temperature of the meat being processed. By this means, low temperature chips, which are solid and hard in nature, are kicked a greater distance by the deflector vane than corresponding chips which are warm and semi-plastic in nature. Since ultimately all the material in the hopper, regardless of its temperature, is usually engaged and processed by the worm, the greater travel by low temperature chips advantageously causes such meat to circulate in the hopper for a greater time before being processed.

It will be seen, therefore, that the present invention provides a simple but extremely effective method of preventing overloading and stalling of the machine as a result of excessive amounts of frozen chips or particles being drawn into and accumulating in the barrel of the apparatus.

DESCRIPTION OF THE PREFERRED EMBODIMENTS

Figure 1:
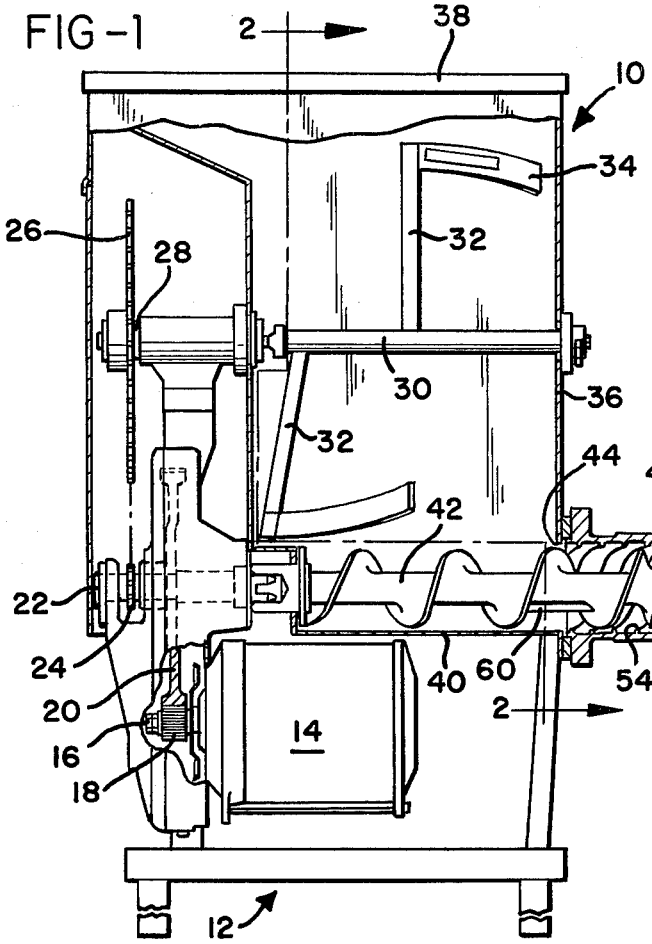
FIG. 1 is a cross-sectional view through apparatus of the present invention.

With reference to FIG. 1 of the drawings, it will be seen that apparatus 10 of the present invention includes a base 12 supporting a motor 14. A motor shaft 16 carries a pinion 18 which meshes with a large diameter gear 20 and drives a shaft 22 carrying a smaller diameter sprocket 24 wrapped by a chain 26 which also wraps a relatively large diameter sprocket on a shaft 28.

Figure 2:
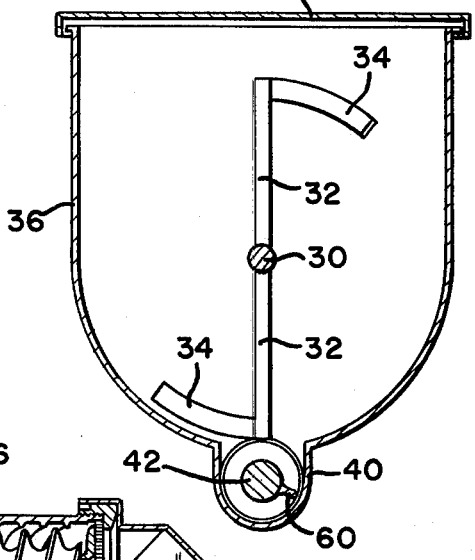
FIG. 2 is a cross sectional view taken on line 2—2 of FIG. 1.

The mixing arm assembly, as seen in FIGS. 1 and 2 of the drawings, includes a driven shaft 30 carrying arms 32 terminating in curved extensions 34. The mixing arm assembly is disposed in a hopper 36 preferably provided with a cover 38 and having an inwardly curved bottom portion communicating with a trough 40 running along the bottom of the hopper.

The large diameter gear 20 drives through a one-way clutch, not shown, a worm 42 which extends along the hopper through 40, through an entrance 44 and into the barrel 46 of the apparatus. A grinder plate 48 is attached to the outer end of the barrel 46 by means of an adjusting ring 50 and a knife 52 carried by the outer end of the worm rotates in cooperation with the plate 48 during operation of the machine. Additionally, the interior of the barrel will normally be provided with internal fluting 54 and a shield 56 may be provided over the exit from the barrel.

The apparatus described thus far is generally similar to that disclosed in detail in the above noted U.S. Pat. No. 3,750,569 and, as a result of the one-way clutch interposed between the drive unit and the worm, the mixing assembly may be operated independently of the worm by rotation in one direction, while the worm and mixer can be operated simultaneously by rotation in the opposite direction.

In accordance with the present invention, however, the worm 42 is provided with deflector means for preventing an accumulation of frozen particles of material within the barrel 46. Thus, a vane 60 extends longitudinally of the worm, projecting radially outwardly from the root of the convoluted surface thereof at the entrance 44 to the barrel. As indicated best in FIG. 5 it has been found desirable to provide the vane with a height which is about one-half that of the worm convolutions.

The vane extends from the hopper through the entrance 44 and into the barrel 46 and, as the worm 42 rotates, acts to deflect or kick out frozen chips or other frozen particles which would otherwise enter the barrel, in sufficient quantities to overload the maachine. The vane 60 has the effect of starving the worm with regard to the entrance of frozen chips while having no effect or minimal effect on the feeding of fresh or non-frozen product. (Such product is usually caught and pulled into the worm by a tail, without influence by the vane.) In practice it has been found that the present invention works efficiently with approximately two-thirds of the vane disposed within the hopper and one-third disposed within the barrel.

Figure 4:
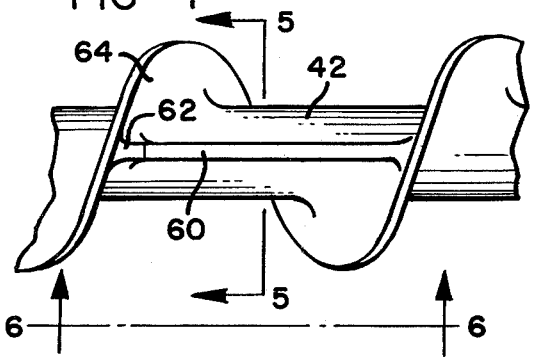
FIG. 4 is a view taken on line 4—4 of FIG. 3.
Figure 3:
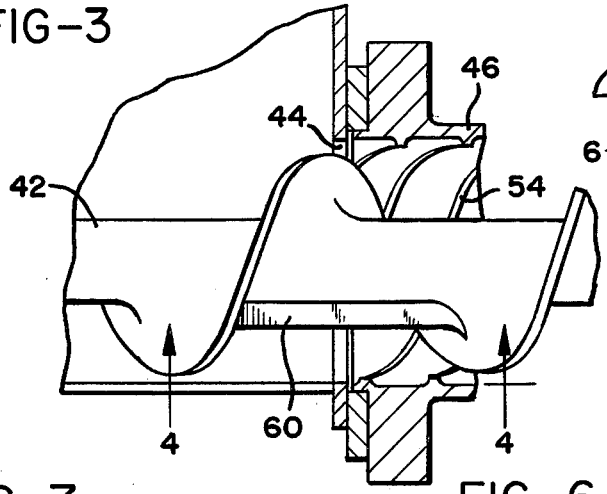
FIG. 3 is an enlarged view of a portion of the apparatus including a worm incorporating a vane type deflector.
Figure 5:
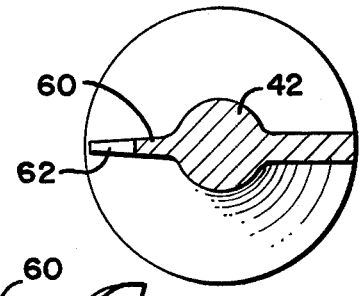
FIG. 5 is a view taken on line 5—5 of FIG. 4.
Figure 6:
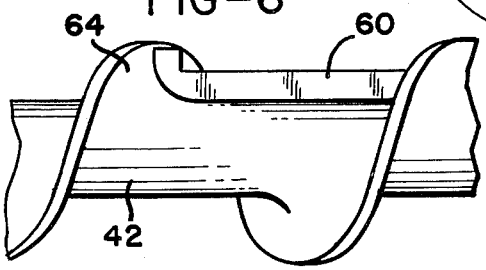
FIG. 6 is a view taken on line 6—6 of FIG. 4.

Additionally, it has been found desirable, as seen in FIGS. 4 through 6 of the drawings, to extend the vane upwardly, as at 62, along a face 64 of a convolution of the worm disposed opposite to the entrance 44 to the barrel. This has been found to improve the efficiency of the unit in kicking out or deflecting frozen particles of material travelling towards the entrance 44 of the barrel of the machine.

Figure 7:
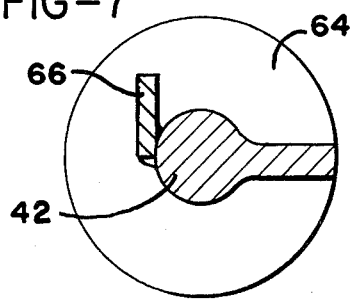
FIG. 7 is a view similar to FIG. 5 but showing a second embodiment of the invention.

While in the embodiment shown in FIGS. 1 through 6 of the drawings the deflector projects substantially radially outwardly with respect to the axis of rotation of the worm, the deflector may, as seen in FIG. 7 of the drawings, take the form of a vane or plate extending chordally of the worm, but otherwise extending, similarly to the vane 60, longitudinally of the worm from the hopper through the entrance 44 and into the barrel of the machine.

In either case, the deflector must be positioned at the entrance to the barrel. Merely positioning the deflector back in the hopper has been found to be ineffective as has positioning the deflector within the barrel. However, when a deflector is mounted on the worm at the entrance to the barrel as described above, the present invention has been found to provide an extremely effective mechanism for minimizing the tendency of a feeder worm to preferentially select and feed frozen chips. The improvement of the present invention prevents an excess of frozen particles from entering the barrel and stalling of the machine, yet the resulting structure is one that is relatively simple in construction and easy to maintain.

As an example of the effectiveness of the chip deflecting vane invention, it has been found that a 10 horsepower grinder which includes a vane in accordance with the parent invention is capable of processing meat at a temperature of 19° Fahrenheit. In comparison, similar machines which do not incorporate the deflecting vane invention stall while attempting to process 25° Fahrenheit meat.

While the forms of apparatus herein described constitute preferred embodiments of the invention, it is to be understood that the invention is not limited to these precise forms of apparatus, and that changes may be made therein without departing from the scope of the invention.

What is claimed is:

1. In apparatus including a hopper, a barrel extending from said hopper, means defining an entrance from said hopper into said barrel and a worm having convolutions defining a convoluted surface thereof and mounted for rotation about an axis extending longitudinally thereof positioned partially in said hopper and extending from said hopper through said entrance and into said barrel, the improvement comprising:

a. deflector means projecting from said surface of said worm where said worm extends from said hopper through said entrance and into said barrel, b. said deflector means having a height substantially less than that of the worm convolutions, thereby limiting the flow of hard individual pieces such as frozen chips without substantially limiting the flow of softer material between said hopper and barrel.

2. The apparatus of claim 1 wherein:

a. said deflector means extends from said hopper through said entrance into said barrel.

3. The apparatus of claim 1 wherein:

a. said deflector means projects from said surface substantially radially with respect to said axis of rotation of said worm.

4. The deflector of claim 2 wherein:

a. said deflector means extends from said hopper through said entrance into said barrel.

5. The apparatus of claim 1 wherein:

a. said deflector means extends along said worm from one convolution thereof positioned in said hopper through said entrance and into said barrel.

6. The deflector of claim 5 wherein:

a. deflector means extends from said one convolution to a second convolution positioned within said barrel.

7. The apparatus of claim 1 wherein:

a. said deflector means comprises a vane extending-longitudinally of said surface, projecting substantially radially outwardly therefrom, and b. a greater portion of said vane is positioned within said hopper than within said barrel.

8. The apparatus of claim 7 wherein:

a. approximately two-thirds of said vane is positioned within said hopper, and b. approximately one-third of said vane is positioned within said barrel.

9. The apparatus of claim 1 wherein:

a. said worm is driven in a unidirectional manner.

10. In apparatus including a hopper, a barrel extending from said hopper, means defining an entrance from said hopper into said barrel and a worm having a convoluted surface and mounted for rotation about an axis extending longitudinally thereof in said hopper and extending through said entrance into said barrel, the improvement comprising:

a. deflector means projecting radially outwardly from said surface of said worm, b. said deflector means extending up a face of a convolution of said worm positioned in said hopper opposite said entrance and along said worm from said convolution through said entrance and into said barrel.

11. In apparatus including a hopper, a barrel extending from said hopper, means defining an entrance from said hopper into said barrel and a worm having a convoluted surface and mounted for rotation about an axis extending longitudinally thereof in said hopper and extending through said entrance into said barrel, the improvement comprising:

a. deflector means at said entrance to said barrel projecting from said surface of said worm substantially chordally with respect to said axis of said worm for deflecting hardened material from said entrance to said barrel.

12. In apparatus including a hopper, a barrel extending from said hopper, means defining an entrance from said hopper into said barrel and a worm having a convoluted surface and mounted for rotation about an axis extending longitudinally thereof in said hopper and extending through said entrance into said barrel, the improvement comprising:

a. deflector means projecting radially outwardly from said surface of said worm at said entrance to said barrel and extending along said worm from one convolution thereof positioned in said hopper, through said entrance and into said barrel and up that face of said one convolution facing said entrance for deflecting hardened material from said entrance to said barrel, and b. said deflector means projecting from the root of said convoluted worm surface substantially one-half the height of the worm convolutions.

* * * * *

UNITED STATES PATENT OFFICE

CERTIFICATE OF CORRECTION

Patent No. 3,984,056 Dated October 5, 1976

Inventor(s) Richard S. Hartley & Bernardus J. van Mouwerik

It is certified that error appears in the above-identified patent and that said Letters Patent are hereby corrected as shown below:

The name of "Bernardus J. van Mouwerik" has been omitted as an inventor.

Column 3, line 21, "through" should be --- trough ---.

Column 4, line 65, "2" should be --- 3 ---.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*